US010124818B2

(12) United States Patent
Wang et al.

(10) Patent No.: US 10,124,818 B2
(45) Date of Patent: Nov. 13, 2018

(54) RAILWAY VEHICLE AND LOCAL MULTI-FUNCTIONAL MEMBER THEREOF

(71) Applicant: CRRC QINGDAO SIFANG CO., LTD., Qingdao, Shandong (CN)

(72) Inventors: Fei Wang, Shandong (CN); Shuxiang Chen, Shandong (CN); Fujun Kou, Shandong (CN); Xianliang Sun, Shandong (CN); Yonggui Zhang, Shandong (CN); Wenbin Chen, Shandong (CN); Aiqin Tian, Shandong (CN); Sansan Ding, Shandong (CN); Jun Wang, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 56 days.

(21) Appl. No.: 15/512,551

(22) PCT Filed: Nov. 13, 2015

(86) PCT No.: PCT/CN2015/094561
§ 371 (c)(1),
(2) Date: Mar. 18, 2017

(87) PCT Pub. No.: WO2016/124024
PCT Pub. Date: Aug. 11, 2016

(65) Prior Publication Data

US 2018/0178819 A1 Jun. 28, 2018

(30) Foreign Application Priority Data

Feb. 5, 2015 (CN) ..... 2015 1 0061552
Feb. 5, 2015 (CN) ..... 2015 2 0083554 U

(51) Int. Cl.
*B61F 5/12* (2006.01)

(52) U.S. Cl.
CPC ..... *B61F 5/12* (2013.01)

(58) Field of Classification Search
CPC .. B61F 5/12; B61F 5/122; B61F 5/125; B61F 5/22; B61F 5/28; B61F 5/30
See application file for complete search history.

(56) References Cited

U.S. PATENT DOCUMENTS 4,316,417 A * 2/1982 Martin ..... B61F 5/34 105/198.5
6,276,283 B1 * 8/2001 Weber ..... B61F 5/122 105/225
6,701,850 B2 * 3/2004 McCabe ..... B61F 5/122 105/198.5

FOREIGN PATENT DOCUMENTS

CN 201214427 Y 4/2009
CN 201890234 U 7/2011
(Continued)

OTHER PUBLICATIONS

International Search Report for PCT/CN2015/094561, dated Feb. 17, 2016, ISA/CN.

*Primary Examiner* — Jason C Smith
(74) *Attorney, Agent, or Firm* — U.S. Fairsky LLP; Yue (Robert) Xu

(57) ABSTRACT

A railway vehicle local multi-functional component includes a main body. The main body is an aluminum alloy profile, a reinforcing plate is provided on an outer surface of a bottom plate of the aluminum alloy profile as a vehicle lifting pad, built-in threaded seats are provided on an inner surface of the bottom plate of the aluminum alloy profile as a mounting seat for an anti-yaw damper of a bogie, and a through hole integrally formed with the aluminum alloy profile is provided in the aluminum alloy profile as a cable passage. Multifunction is realized by one structure, thus greatly simplifying the vehicle body local structure, and
(Continued)

improving structural strength. A railway vehicle including the local multi-functional component is included.

20 Claims, 5 Drawing Sheets

(56) References Cited

FOREIGN PATENT DOCUMENTS

| | | | |
|---|---|---|---|
| CN | 202016477 | U | 10/2011 |
| CN | 202115536 | U | 1/2012 |
| CN | 202243510 | U | 5/2012 |
| CN | 202624252 | U | 12/2012 |
| CN | 202783231 | U | 3/2013 |
| CN | 203372251 | U | 1/2014 |
| CN | 104648422 | A | 5/2015 |
| CN | 204605824 | U | 9/2015 |
| DE | 102012223476 | A1 | 6/2014 |
| JP | 2003-63394 | A | 3/2003 |
| KR | 10-2012-0093012 | A | 8/2012 |

* cited by examiner

RAILWAY VEHICLE AND LOCAL MULTI-FUNCTIONAL MEMBER THEREOF

This application is the national phase of International application No. PCT/CN2015/094561, titled "RAILWAY VEHICLE AND LOCAL MULTI-FUNCTIONAL MEMBER THEREOF", filed on Nov. 13, 2015, which claims the benefits of priorities to Chinese patent application No. 201510061552.8, titled "RAIL VEHICLE AND LOCAL MULTIFUNCTIONAL COMPONENT THEREOF", filed with the Chinese State Intellectual Property Office on Feb. 5, 2015 and Chinese patent application No. 201520083554.2, titled "RAIL VEHICLE AND LOCAL MULTIFUNCTIONAL COMPONENT THEREOF", filed with the Chinese State Intellectual Property Office on Feb. 5, 2015, the entire disclosures of which applications are incorporated herein by reference.

FIELD

The present application relates to the technical field of rail vehicles, and particularly to a local multifunctional component for a rail vehicle. The present application further relates to a rail vehicle including the local multifunctional component.

BACKGROUND

An anti-yaw damper is also referred to as a secondary longitudinal damper. Two anti-yaw dampers are mounted between a car body and a bogie frame of each bogie, and the function of the anti-yaw dampers is to prevent the bogie of a train from yawing when the train is running at a high speed, thus the anti-yaw damper is an important component for improving the motion stability of a locomotive vehicle.

Presently, when the anti-yaw damper is mounted, a large end of the anti-yaw damper is connected to an upper bolster through an upper anti-yaw damper seat, and a small end thereof is connected to a frame through a lower anti-yaw damper seat.

The upper anti-yaw damper seat is spliced by multiple aluminum plates through welding. The upper anti-yaw damper seat has the following deficiencies.

Firstly, since the upper anti-yaw damper seat is spliced by multiple aluminum plates through welding, a lot of welding work and adjusting work caused by welding deformation have to be done in the production process.

Secondly, when the upper anti-yaw damper seat is used as a vehicle lifting part, a lifting hole needs to be machined in a side sill of the car body. However, opening a hole may reduce the strength and rigidity of the car body.

Moreover, for ease of a cable passing through the interior of the upper anti-yaw damper seat, a sleeve should be welded to an inner cavity of the upper anti-yaw damper, which may result in a complicated process, a complicated structure and a high cost.

Therefore, a technical issue to be addressed by those skilled in the art is to optimize the upper mounting seat for the anti-yaw damper.

SUMMARY

A first object of the present application is to provide a rail vehicle local multifunctional component. By employing an aluminum alloy profile as a main body, the rail vehicle local multifunctional component can serve as a mounting plane for an anti-yaw damper of a bogie as well as can serve as a car body lifting part, and also can provide a safe passage for cables of electrical equipment. Therefore, multiple functions are achieved by one structure, and the car body local structure is significantly simplified.

A second object of the present application is to provide a rail vehicle including the rail vehicle local multifunctional component.

To achieve the above objects, a rail vehicle local multifunctional component is provided according to the present application. A main body of the rail vehicle local multifunctional component is an aluminum alloy profile, a reinforcing plate is provided at an outer surface of a bottom plate of the aluminum alloy profile and the reinforcing plate serves as a vehicle lifting pad, built-in threaded seats are provided at an inner surface of the bottom plate of the aluminum alloy profile as a mounting seat for an anti-yaw damper of a bogie, and a through hole integrally formed with the aluminum alloy profile is provided inside the aluminum alloy profile as a cable passage.

Preferably, a cross section of the aluminum alloy profile has a rectangular shape, an interior of the aluminum alloy profile is separated into an upper cavity and a lower cavity, an X-shaped crossed inner rib is provided inside the upper cavity, a crossed part of the X-shaped crossed inner rib forms the cable passage, and a V-shaped inner rib is provided inside the lower cavity.

Preferably, the cross section of the cable passage has a circular or oblong shape.

Preferably, one end of the aluminum alloy profile is a first bevel with a side plate at inner side being short and a side plate at outer side being long, a length of the side plate at outer side protrudes beyond the first bevel by a certain distance. On the other end of the aluminum alloy profile, an upper half is an upright surface, a lower half is a second bevel with a bottom plate being short, and the middle is a retaining edge extending outwards in a transverse direction.

Preferably, a plug-welding hole is provided in a portion of the side plate at outer side, which portion protrudes beyond the first bevel.

Preferably, the portion of the side plate at outer side, which portion protrudes beyond the first bevel has a bevel edge formed by cutting a lower corner part off.

Preferably, the first bevel and the second bevel of the aluminum alloy profile are provided covering plates respectively.

Preferably, the threaded seats each have a long strip shape, and the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

To achieve the above second object, a rail vehicle is further provided according to the present application. The rail vehicle includes a car body, a bogie and an anti-yaw damper, an upper mounting seat for the anti-yaw damper is connected to a bolster and an edge beam of the car body, and the upper mounting seat is the rail vehicle local multifunctional component according to any one of the above aspects.

Preferably, the bottom surface of the edge beam is in the same plane as the vehicle lifting pad or above the vehicle lifting pad.

The novelly designed aluminum alloy profile is employed as a carrier in the present application, and by processing the profile and assembly welding of aluminum plates at the local portion of the profile and the riveting of the threaded seats at the local portion of the profile, the functions for mounting the anti-yaw damper of a bogie, lifting up a car body and providing a cable passage are achieved. Compared with the original anti-yaw damper seat spliced by multiple aluminum plates through welding, welding work and adjusting work caused by welding deformation are significantly reduced. Compared with the original vehicle lifting part, there is no need to machine a lifting hole in the edge beam of the car body, and thus the strength and the rigidity of the car body are increased. Compared with using a welded sleeve to allow the cable pass through previously, a cable through hole is directly provided in the profile section of the present structure, thus the welded sleeve is not required any more. On the premise of ensuring the safety of the vehicle, optimization, modularization and multifunctionalization of a complicated structure are realized, thus a manufacturing difficulty is reduced and a production efficiency is increased.

In a preferred solution, one end of the aluminum alloy profile is a first bevel with a side plate at inner side being short and a side plate at outer side being long, and a length of the side plate at outer side protrudes beyond the first bevel by a certain distance. With such a structure form, it may be guaranteed that the weld seam between the aluminum alloy profile and the edge beam of the car body is enough long, thus the connection strength of the aluminum alloy profile and the edge beam is increased and meanwhile the mounting space of the bogie can be avoided.

The rail vehicle provided according to the present application is provided with the above rail vehicle local multifunctional component. Since the rail vehicle local multifunctional component has the above technical effects, the rail vehicle provided with the rail vehicle local multifunctional component also has the corresponding technical effects.

BRIEF DESCRIPTION OF THE DRAWINGS

For more clearly illustrating embodiments of the present application or technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

REFERENCE NUMERALS IN FIGURES

Figure 1:
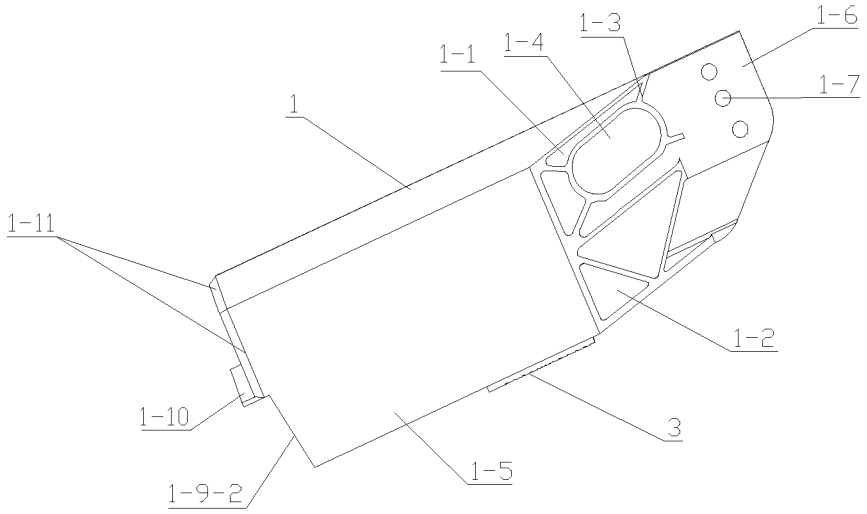
FIG. 1 is a perspective view of a rail vehicle local multifunctional component according to the present application.

| | | | |
|---|---|---|---|
| 1 | aluminium alloy profile, | 1-1 | upper cavity, |
| 1-2 | lower cavity, | 1-3 | inner rib, |
| 1-4 | through hole, | 1-5 | side plate at inner side, |
| 1-6 | side plate at outer side, | 1-7 | plug-welding hole, |
| 1-8 | upright surface, | 1-9-1 | first bevel, |
| 1-9-2 | second bevel, | 1-10 | retaining edge, |
| 1-11 | beveled edge, | 1-12 | bottom plate, |
| 2 | threaded seat, | 3 | vehicle lifting pad, |
| 4 | bolster, | 5 | covering plate, |
| 6 | anti-yaw damper, and | 7 | edge beam. |

DETAILED DESCRIPTION

To make the objects, technical solutions and advantages of the embodiments of the present application more clear, the technical solutions of the embodiments of the present application will be clearly and completely described hereinafter in conjunction with the drawings of the embodiments of the present application. Apparently, the embodiments described are some examples of the present application, and not all implementations. Other embodiments obtained by those skilled in the art based on the embodiments of the present application without any creative efforts all fall into the protection scope of the present application.

Herein, terms "upper", "lower", "inner" and "outer" are defined based on the position relationships shown in the drawings. Corresponding position relationships may be changed in different drawings. Therefore, these terms should not be construed as an absolute limit to the protection scope.

Figure 2:
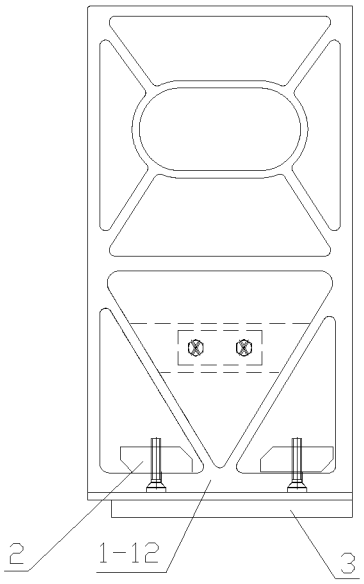
FIG. 2 is a schematic view of an end face of the rail vehicle local multifunctional component according to the present application.
Figure 3:
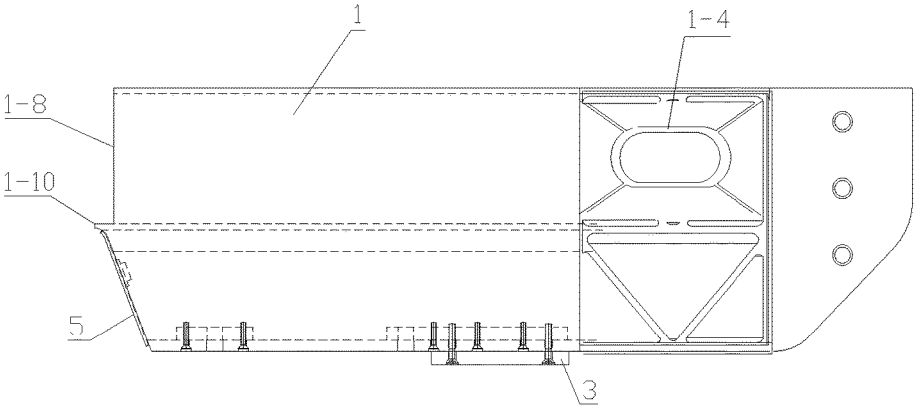
FIG. 3 is a left view of FIG. 2.
Figure 4:
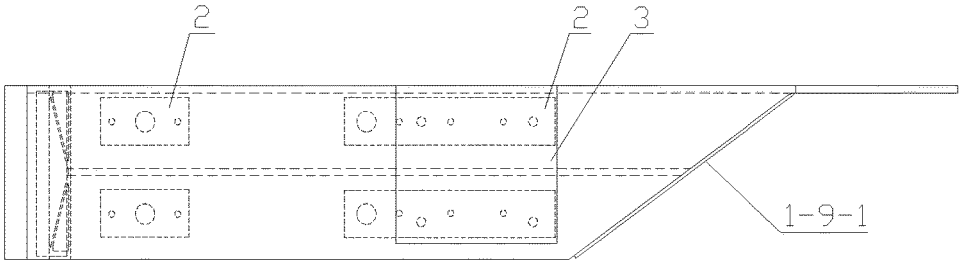
FIG. 4 is a top view of FIG. 3.

Referring to FIGS. 1, 2, 3 and 4, FIG. 1 is a perspective view of a rail vehicle local multifunctional component according to the present application, FIG. 2 is a schematic view of an end face of the rail vehicle local multifunctional component according to the present application, and FIG. 3 is a left view of FIG. 2 and FIG. 4 is a top view of FIG. 3.

In a specific embodiment, the main body of the rail vehicle local multifunctional component according to the present application is an aluminum alloy profile 1 with a cross section having a rectangular shape. An interior of the aluminum alloy profile 1 is separated into two cavities, which are respectively an upper cavity 1-1 and a lower cavity 1-2. An X-shape crossed inner rib 1-3 is integrally formed inside the upper cavity 1-1. A crossed part of the inner rib 1-3 is an oblong through hole 1-4. The reserved through hole serves as a cable passage. A V-shaped inner rib 1-3, which is opened upwards, is integrally formed inside the lower cavity 1-2.

One end of the aluminum alloy profile 1 is a first bevel 1-9-1 with a side plate at inner side 1-5 being short and a side plate at outer side 1-6 being long, and a length of the side plate at outer side 1-6 protrudes beyond the first bevel by a certain distance. A portion of the side plate at outer side 1-6, which portion protrudes beyond the first bevel has a bevel edge of 45 degrees, which is formed by cutting a lower corner part off, and three plug-welding holes 1-7 are machined in this portion. On another end of the aluminum alloy profile 1, an upper half is an upright surface 1-8, a lower half thereof is a second bevel 1-9-2 with a bottom plate being short, and the middle is a retaining edge 1-10 extending outwards in a transverse direction. A beveled edge 1-11 is machined in a periphery of the upright surface 1-8 for the connection to a bolster through welding.

Built-in threaded seats 2 are provided on an inner surface of a bottom plate 1-12 of the aluminum alloy profile 1 and the built-in threaded seats 2 serve as a mounting seat for an anti-yaw damper of a bogie.

Specifically, the threaded seats 2 each have a long strip shape and there are two groups of threaded seats. Each group includes two threaded seats which are riveted to the inner surface of the bottom plate 1-12 of the aluminum alloy profile 1 through rivets in the manner of being left-right symmetrical on the cross section. One group of threaded seats 2 is shorter and a threaded hole is in the middle of each threaded seat. The other group of threaded seats 2 is longer and a threaded hole is at a position close to one end of each threaded seat. The bottom plate 1-12 is provided with holes corresponding to the threaded holes of the threaded seats for fitting screws or bolts.

A square reinforcing plate is riveted to an outer surface of the bottom plate 1-12 of the aluminum alloy profile 1 and the reinforcing plate serves as a vehicle lifting pad 3. The vehicle lifting pad 3 exactly corresponds to the group of threaded seats 2 which are longer. A rivet of the vehicle lifting pad 3 passes through the vehicle lifting pad 3, the bottom plate 1-12 of the aluminum alloy profile and the threaded seat 2 in the listed sequence from outside to rivet and fix. A bottom surface of the vehicle lifting pad 3 may be provided with a rhombic anti-slip lines or similar structures.

Figure 5:
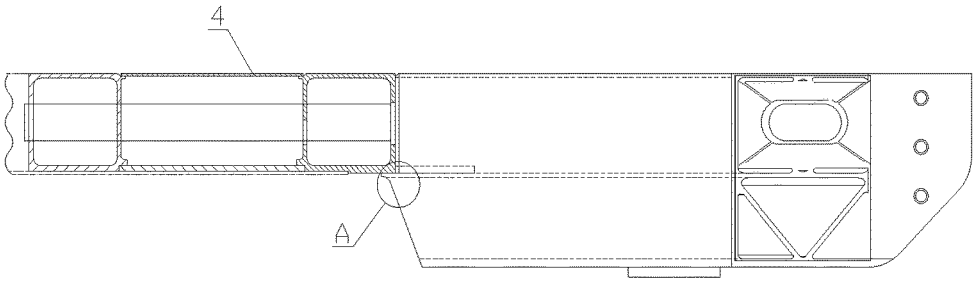
FIG. 5 is a schematic view showing the connection of the rail vehicle local multifunctional component in FIG. 3 and a bolster.
Figure 6:
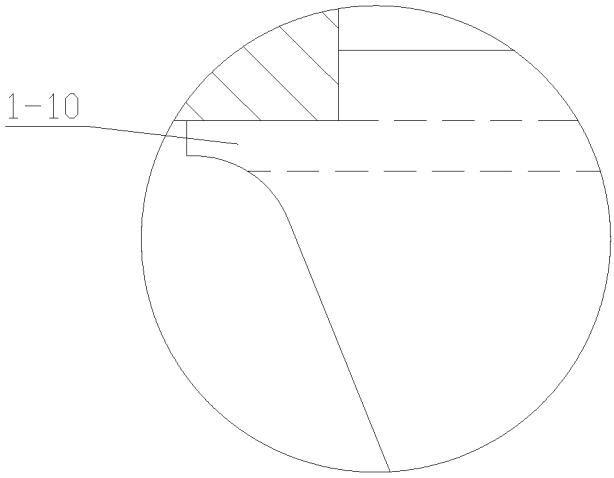
FIG. 6 is a partially enlarged view of part A in FIG. 5.

Referring to FIGS. 5 and 6, FIG. 5 is a schematic view showing the connection of the rail vehicle local multifunctional component in FIG. 3 and a bolster, and FIG. 6 is a partially enlarged view of part A in FIG. 5.

In use, the upright surface 1-8 of the aluminum alloy profile 1 is connected to a bolster 4 by welding. The bolster 4 is supported on the retaining edge 1-10 extending outwards in the transverse direction below the upright surface of the aluminum alloy profile. A beveled edge is machined in the periphery of the upright surface 1-8 for a connection to the bolster 4 through welding.

Furthermore, to prevent the inner cavity of the aluminum alloy profile 1 from opening to outside, corresponding covering plates 5 may be respectively mounted to openings of the two ends of the aluminum alloy profile 1 to cover the openings, thus preventing foreign objects from entering the aluminum alloy profile 1.

Owning to the new developed profile section and artful design, the structure may serve as both a mounting plane for the anti-yaw damper of a bogie and a car body lifting part, and also may provide a safe passage for cables of electrical equipment. Therefore, multiple functions may be realized by one structure and thus the local structure of the car body is significantly simplified.

The above embodiments are only preferred solutions of the present application, and the present application is not limited to these solutions. Based on these solutions, specific adjustments may be made according to actual needs and different embodiments may be obtained. For example, the section of the aluminum alloy profile may be designed in a square or trapezoidal shape, or the inner rib of the profile may be designed in other shapes. Since there are too many possible implementation ways, illustration is not made one by one herein.

Figure 7:
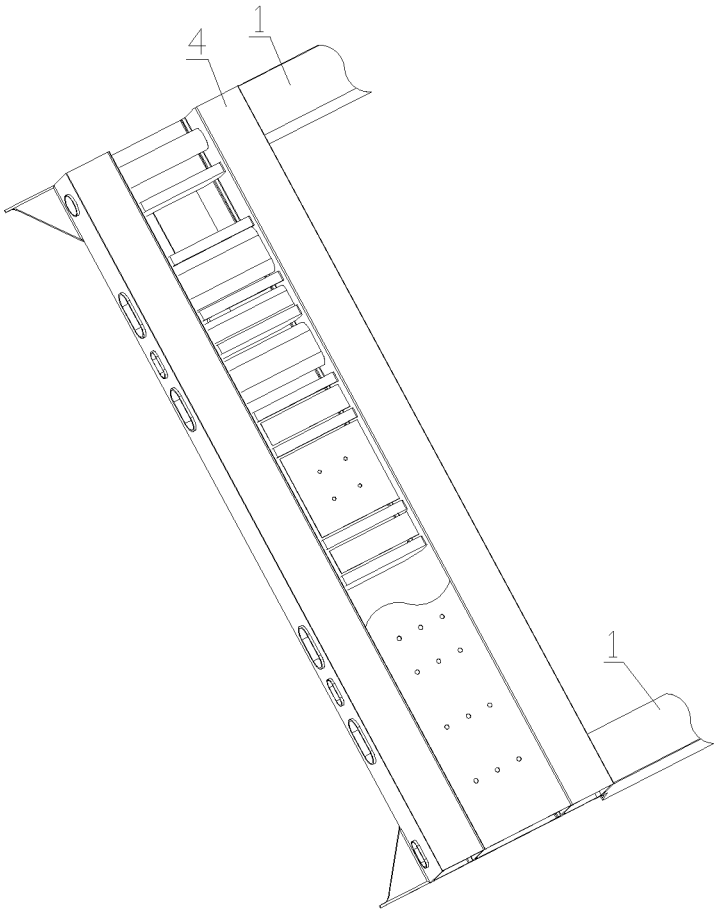
FIG. 7 is a schematic view showing the connection of the rail vehicle local multifunctional component according to the present application and the bolster when viewed from the top.
Figure 8:
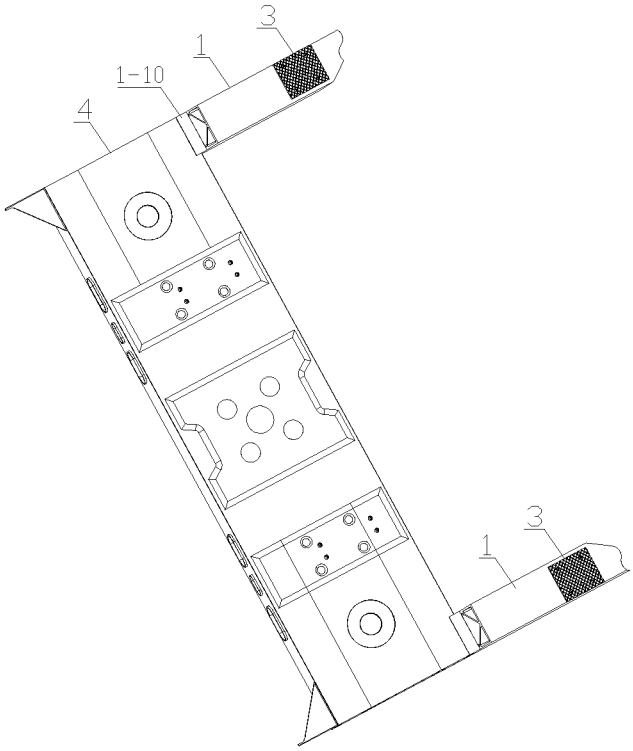
FIG. 8 is a schematic view showing the connection of the rail vehicle local multifunctional component according to the present application and the bolster when viewed from the bottom.
Figure 9:
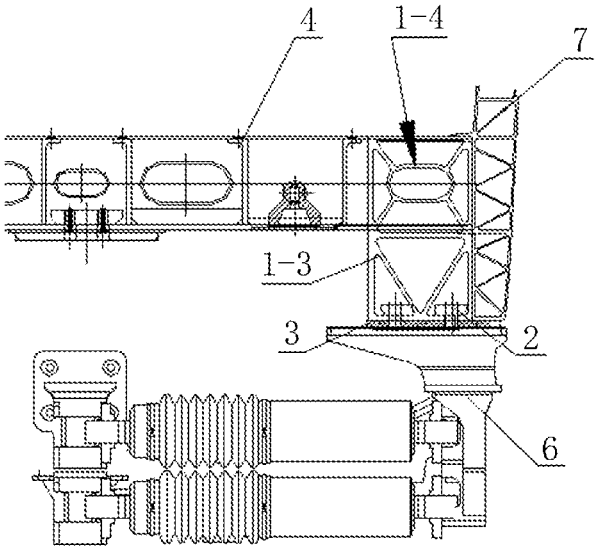
FIG. 9 is a schematic view showing the connection of the rail vehicle local multifunctional component according to the present application and an anti-yaw damper.

Referring to FIGS. 7, 8 and 9, FIG. 7 is a schematic view showing the connection of the rail vehicle local multifunctional component according to the present application and the bolster when viewed from the top; FIG. 8 is a schematic view showing the connection of the rail vehicle local multifunctional component according to the present application and the bolster when viewed from the bottom; and FIG. 9 is a schematic view showing the connection of the rail vehicle local multifunctional component according to the present application to an anti-yaw damper.

In addition to the above rail vehicle local multifunctional component, a rail vehicle is further provided according to the present application. The rail vehicle includes components such as a car body, a bogie and an anti-yaw damper 6. An upper mounting seat of the anti-yaw damper 6 is connected to a bolster 4 and an edge beam 7 of the car body through welding. The upper mounting seat is the rail vehicle local multifunctional component described hereinbefore.

As described above, the oblong through hole 1-4 reserved in the aluminum alloy profile 1 serves as the cable passage. After the assembly is completed, the beveled edge of the upright surface of the profile and the bolster 4 of an underframe are welded to each other, and the side plate at outer side 1-6, which is longer, is welded to the edge beam 7 of the underframe and thus an integrated structure is formed. Also, a corresponding part of the edge beam 7 is milled to be in the same plane as the vehicle lifting pad 3 (or above the vehicle lifting pad 3), thus serving as the car body lifting part.

Since the side plate at outer side 1-6 of the aluminum alloy profile 1 is longer, it may be guaranteed that a weld seam between the aluminum alloy profile 1 and the edge beam 7 of the car body is enough long (is approximately 1260 mm), thus the connection strength of the aluminum alloy profile 1 and the edge beam 7 is increased and meanwhile the mounting space of the bogie can be avoided. Also, the plug-welding holes 1-7 are further machined in the side plate at outer side 1-6, and the side plate at outer side 1-6 is plug-welded to the edge beam 7 of the car body through the plug-welding holes 1-7, thus the connection strength of the aluminum alloy profile and the edge beam 7 is also increased. Other structures may refer to the conventional technology and are not described herein.

Specifically, processing and mounting sequences are as follows. Firstly, the aluminum alloy profile 1 is processed. Then components such as the vehicle lifting pad 3 and the threaded seats 2 are assembled on the aluminum alloy profile 1. Finally, the aluminum alloy profile assembly is welded to the bolster 4 and the edge beam 7 of the car body.

Compared with the original anti-yaw damper seat spliced by multiple aluminum plates through welding, welding work and adjusting work due to welding deformation are significantly reduced. Compared with the original lifting part, there is no need to machine a lifting hole in the edge beam of the car body, thus the strength and the rigidity of the car body are increased. Compared with using a welded sleeve to allow the cable pass through, in this structure, the cable through hole is directly provided in the profile section and thus the welded sleeve is not required any more.

On the premise of ensuring the safety of a train, optimization, modularization and multifunctionalization of a complicated structure are realized and thus a manufacturing difficulty is reduced and a production efficiency is increased.

A rail vehicle and a local multifunctional component according to the present application are described in detail hereinbefore. The principle and the embodiments of the present application are illustrated herein by specific examples. The above description of examples is only intended to help the understanding of the idea of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. A rail vehicle local multifunctional component, wherein a main body of the rail vehicle local multifunctional component is an aluminum alloy profile, a reinforcing plate is provided on an outer surface of a bottom plate of the aluminum alloy profile as a vehicle lifting pad, built-in threaded seats are provided on an inner surface of the bottom plate of the aluminum alloy profile as a mounting seat for an anti-yaw damper of a bogie, and a through hole integrally formed with the aluminum alloy profile is provided in the aluminum alloy profile as a cable passage.

2. The rail vehicle local multifunctional component according to claim 1, wherein a cross section of the aluminum alloy profile has a rectangular shape, an interior of the aluminum alloy profile is separated into an upper cavity and a lower cavity, an X-shaped crossed inner rib is provided inside the upper cavity, the through hole is formed in a crossed part of the X-shaped crossed inner rib, and a V-shaped inner rib is provided inside the lower cavity.

3. A rail vehicle, comprising a car body, a bogie and an anti-yaw damper, wherein an upper mounting seat for the anti-yaw damper is connected to a bolster and an edge beam of the car body, and the upper mounting seat is the rail vehicle local multifunctional component according to claim 2.

4. The rail vehicle local multifunctional component according to claim 2, wherein the cross section of the through hole has a circular or oblong shape.

5. The rail vehicle local multifunctional component according to claim 4, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

6. A rail vehicle, comprising a car body, a bogie and an anti-yaw damper, wherein an upper mounting seat for the anti-yaw damper is connected to a bolster and an edge beam of the car body, and the upper mounting seat is the rail vehicle local multifunctional component according to claim 4.

7. The rail vehicle local multifunctional component according to claim 2, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

8. The rail vehicle local multifunctional component according to claim 1, wherein one end of the aluminum alloy profile is a first bevel with a side plate at inner side being short and a side plate at outer side being long;

a length of the side plate at outer side protrudes beyond the first bevel by a certain distance;

on another end of the aluminum alloy profile, an upper half is an upright surface, a lower half is a second bevel with a bottom plate being shorter, and the middle is a retaining edge extending outwards in a transverse direction.

9. A rail vehicle, comprising a car body, a bogie and an anti-yaw damper, wherein an upper mounting seat for the anti-yaw damper is connected to a bolster and an edge beam of the car body, and the upper mounting seat is the rail vehicle local multifunctional component according to claim 8.

10. The rail vehicle local multifunctional component according to claim 8, wherein a plug-welding hole is provided in a portion of the side plate at outer side, which portion protrudes beyond the first bevel.

11. The rail vehicle local multifunctional component according to claim 10, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

12. A rail vehicle, comprising a car body, a bogie and an anti-yaw damper, wherein an upper mounting seat for the anti-yaw damper is connected to a bolster and an edge beam of the car body, and the upper mounting seat is the rail vehicle local multifunctional component according to claim 10.

13. The rail vehicle local multifunctional component according to claim 10, wherein the portion of the side plate at outer side, which portion protrudes beyond the first bevel, has a bevel edge formed by cutting a lower corner part off.

14. The rail vehicle local multifunctional component according to claim 13, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

15. The rail vehicle local multifunctional component according to claim 13, wherein the first bevel and the second bevel of the aluminum alloy profile are provided with covering plates respectively.

16. The rail vehicle local multifunctional component according to claim 15, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

17. The rail vehicle local multifunctional component according to claim 8, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

18. The rail vehicle local multifunctional component according to claim 1, wherein the threaded seats each have a long strip shape, the threaded seats are riveted to the inner surface of the bottom plate of the aluminum alloy profile and are left-right symmetric in the cross section of the aluminum alloy profile, and the bottom plate is provided with holes corresponding to the threaded holes of the threaded seats.

19. A rail vehicle, comprising a car body, a bogie and an anti-yaw damper, wherein an upper mounting seat for the anti-yaw damper is connected to a bolster and an edge beam of the car body, and the upper mounting seat is the rail vehicle local multifunctional component according to claim 1.

20. The rail vehicle according to claim 19, wherein the bottom surface of the edge beam is in the same plane as the vehicle lifting pad or is above the vehicle lifting pad.

* * * * *